United States Patent [19]

Napier

[11] 4,173,210

[45] Nov. 6, 1979

[54] BOW STRING RELEASE DEVICE

[76] Inventor: Loyd S. Napier, Rte. 1, Box 417A, Sapulpa, Okla. 74066

[21] Appl. No.: 865,626

[22] Filed: Dec. 29, 1977

Related U.S. Application Data

[63] Continuation-in-part of Ser. No. 684,114, May 7, 1976, Pat. No. 4,066,060.

[51] Int. Cl.[2] ..... F41B 5/00

[52] U.S. Cl. ..... 124/35 A

[58] Field of Search ..... 124/35 A, 41 A, 24 R, 124/23 R

[56] References Cited

U.S. PATENT DOCUMENTS

| | | | |
|---|---|---|---|
| 3,845,752 | 11/1974 | Barner | 124/35 A |
| 3,937,206 | 2/1976 | Wilson | 124/35 A |
| 3,952,720 | 4/1976 | Wilson | 124/35 A |
| 4,009,703 | 3/1977 | Cunningham | 124/35 A |
| 4,066,060 | 1/1978 | Napier | 124/35 A |

*Primary Examiner*—Richard C. Pinkham

*Assistant Examiner*—William R. Browne

*Attorney, Agent, or Firm*—Head, Johnson & Chafin

[57] ABSTRACT

A trigger device for facilitating pulling of a bow string and for quick release of the taut bow string for propelling an arrow from the bow, said trigger device comprising a main body portion provided with suitable finger receiving recesses and a secondary body portion substantially perpendicular to the main body portion having a bow string hold and releasing latch mechanism carried thereby. The latching mechanism comprises a flexible loop member adapted for encircling the bow string and engaging a loop receiving recess provided in the secondary body portion. A latch member extends across the open end of the loop receiving recess and is operably connected with a release trigger by way of a pivotal bell crank and a lever member whereby a light touch of the trigger member by the finger of the archer quickly causes the bell crank and lever member to operate to release the latch member for release of the taut bow string.

3 Claims, 9 Drawing Figures

BOW STRING RELEASE DEVICE

CROSS-REFERENCE TO RELATED APPLICATION

This is a continuation-in-part application of my copending application Ser. No. 684,114, filed May 7, 1976, and entitled "BOW STRING RELEASE DEVICE" now U.S. Pat. No. 4,066,060.

BACKGROUND OF THE INVENTION

1. Field of the Invention

This invention relates to improvements in bow string trigger devices and more particularly, but not by way of limitation, to a trigger device for easily pulling the bow string taut and quickly and smoothly releasing the taut bow string.

2. Description of the Prior Art

In the usual present-day use of the bow and arrow, the bow string is pulled away from the bow by the forefinger and middle finger of the archer's hand. The string is normally somewhat difficult to pull back and requires considerable pressure, which may be very uncomfortable or painful for the fingers. In order to facilitate the pulling of the bow string, trigger devices have been developed which may be held somewhat comfortably in the hand and in turn engage the bow string. One such device is shown in the Barner U.S. Pat. No. 3,845,752, issued Nov. 5, 1974, and entitled "Combined Bowstring Draw and Trigger Release Mechanism for Use in Archery". These devices have been of great help, but they have certain disadvantages in that the release of the bow string is usually not quick enough or smooth enough and frequently interferes with the accuracy and overall result of the archery operation.

SUMMARY OF THE INVENTION

The present invention contemplates a novel trigger device for a bow and arrow which has been particularly designed and constructed for overcoming the forgoing disadvantages. The novel trigger device comprises a main body portion having suitable finger receiving recesses along at least one edge thereof whereby the device may be comfortably held in one hand or the other during the archery operation. A secondary body portion extends substantially perpendicularly from the main body portion and is provided with latching means at the outer end thereof for engaging and releasing the bow string. The latching means comprises a flexible loop, preferably constructed of suitable string material, secured to the secondary body and adapted to encircle a portion of the bow string. A loop receiving recess is provided in the outer end of the secondary body for receiving the loop therein subsequent to wrapping of the loop around the bow string, thus securing the bow string to the trigger device. A releasable latch member extends across the open end of the loop receiving recess and is movable in one direction for opening to permit the loop to be inserted into the recess, and movable in an opposite direction for closing to retain the loop therein. A release trigger member is provided in the main body portion and disposed at a convenient position for manipulation by the fingers of the archer, preferably the little finger. The release trigger member is operably connected with the latch member through complementary spring urged levers whereby the latch member is quickly and easily moved away from the open end of the loop receiving recess when the trigger member is engaged or tripped. When the latch member is removed from its position across the open end of the loop receiving recess, the loop is released from its position therein, and the bow string is quickly and efficiently released for propelling of the arrow in the usual manner. In order to reset the complementary lever members for returning the latch member to the closed position thereof across the loop receiving recess, a reset lever is provided for pivoting of the lever member to the latch locking position therefor. The levers or bell crank members connected between the trigger member and the latch member are particularly designed for efficiency and accuracy of operation in releasing the latch member.

DESCRIPTION OF THE PREFERRED EMBODIMENTS

Figure 3:
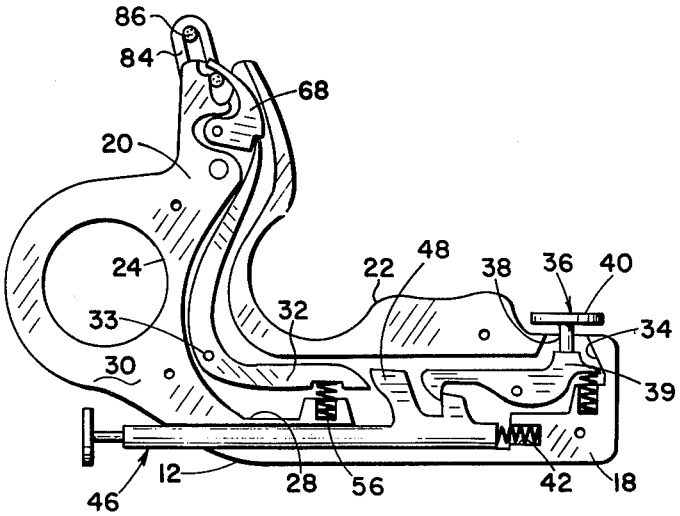
FIG. 3 is a view similar to FIG. 2 illustrating the latch member in a closed position.
Figure 2:
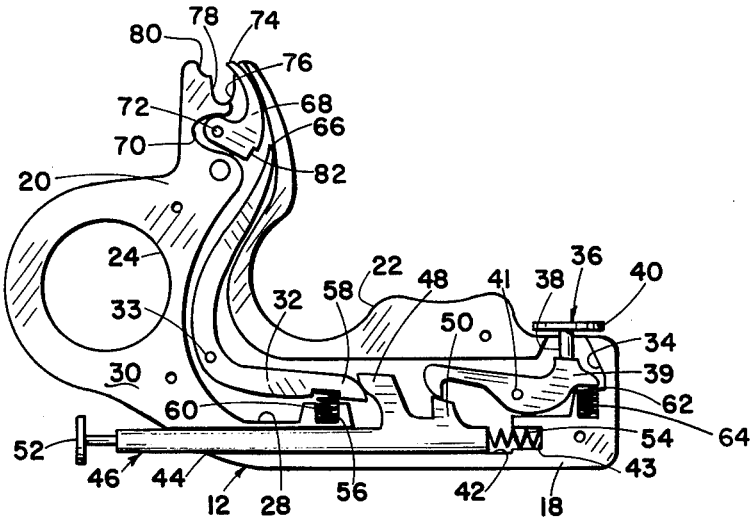
FIG. 2 is a side elevational view of one half section of the bow string draw and release device shown in FIG. 1 and illustrating the latch member in an open position.
Figure 1:
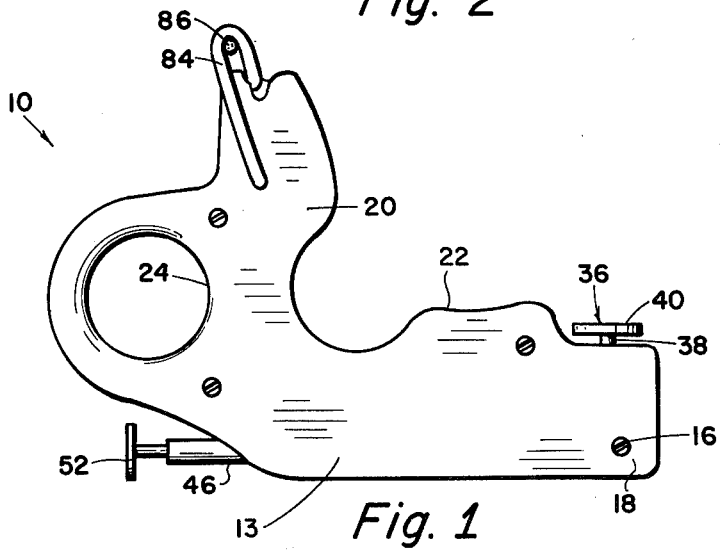
FIG. 1 is a side elevational view of a bow string draw and release device embodying the invention.

Referring to the drawings in detail, and particularly FIGS. 1 through 3, reference character 10 generally indicates a bow string draw and release device comprising a pair of substantially identical but opposite half sections 12 and 13 removably secured together in any well known manner, such as by a plurality of screws 16. Since the half sections 12 are substantially identical, but mirror images of one another, only one of the sections 12 will be set forth in detail herein.

The half section 12 comprises a somewhat elongated substantially flat main body portion 18 having a secondary flat body portion 20 extending substantially perpendicularly therefrom, and a preferably integral therewith, but not limited thereto. One edge of the main body 18 is contoured to suitable finger receiving recesses as shown at 22 for facilitating use of the device 10 as will be hereinafter set forth. In addition, an aperture 24 is preferably provided in the secondary body portion 20 for receiving a finger (not shown) of the operator of the device during use thereof.

A substantially L-shaped groove 28 is provided on the inwardly directed face 30 of the half section 12 for cooperating with the groove 28 of the other half section 12 to provide an internal passageway for receiving a bell crank member 32 which is pivotally secured therein at 33. An auxiliary recess 34 is provided in the face 30 to provide communication between the recess 28 and the open area in the proximity of the finger receiving contours 22 as particularly shown in FIGS. 1 and 2. A trigger member 36 comprising a stem 38 and a head member 40 is disposed in the recess 34 in such a manner that the stem 38 extends into engagement with a second bell crank member 39 which is pivotally secured in the recess 28 at 41, and the head member 40 is disposed exteriorly of the body portion 18 in the proximity of the finger receiving contours 22. The stem 38 may be adjustably secured to the bell crank 41, if desired, and in any well known manner, such as by a threaded connection therewith (not shown).

A second auxiliary recess 42 is provided in the face 30 in open communication with the recess 28, and having one closed end 43 and one open end 44. A lever member 46 is slidably disposed within the recess 42 and is provided with a pair of spaced flanges or shoulder members 48 and 50 which extend into the recess 28 for a purpose as will be hereinafter set forth. A suitable head member 52 is preferably provided on the outer end of the lever member 46 for facilitating slidable movement thereof within the recess 42 in one direction. A suitable helical spring 54 is disposed in the recess 42 opposite the open end 44 and has one end anchored against the closed end 43 and the opposite end in engagement with the lever 46 for constantly urging the lever in a direction toward the open 44. The flange 48 is adapted for intermittent engagement with the bell crank 32, and the flange 50 is in constant engagement with the bell crank 39, as will be hereinafter set forth.

A recess 56 is provided in the face 30 in communication with the recess 28 in the proximity of the right band end portion 58 of the bell crank 32 as viewed in the drawings for receiving a suitable helical spring 60 therein which engages the bell crank 32 for constantly urging the bell crank 32 in a counterclockwise direction about the pivot point 33. In addition, a recess 62 is provided in the face 30 oppositely disposed from the recess 34, and a suitable helical spring 64 is disposed in the recess 62 which constantly engages the bell crank 39 for constantly urging the bell crank 39 in a counterclockwise direction about the pivot point 41.

The bell crank 32 is of a substantially L-shaped configuration, complementary to the configuration of the recess 28, and as hereinbefore set forth may be pivotally secured therein in any suitable manner, such as by the pivot pin 33. The upstanding end 66 of the bell crank 32, as viewed in FIGS. 2 and 3, is curved or bent in a rearward direction in such a manner that it terminates at a point disposed between the pivot pin 48 and the end 58 of the bell crank 32. In addition, the end 66 is preferably of a tapered configuration and terminates in a relatively thin or pointed element for engagement with a pivotal latch member 68. The latch member 68 is pivotally secured within an enlarged recess portion 70 conterminous with the recess 28 by a suitable pivot pin 72 and is so constructed that the preponderance of weight of the latch member 68 normally lies on the right hand side of the pivot 72, as viewed in FIGS. 2 and 3, whereby gravity constantly urges the latch member 68 to rotate about the pivot 72 in a clockwise direction as viewed in FIGS. 1 through 3.

The outer end 74 of the latch member 68 is of a tongue-like configuration and extends through an open end 76 of the enlarged recess 70 and into a loop receiving recess or groove 78 provided in the outer end of the secondary body portion 20. In one position of the latch member 68, as shown in FIG. 2, the latch end 74 is disposed at one side of the loop receiving recess 78, or may be completely withdrawn therefrom; and in another position of the latch member 68, as shown in FIG. 3, the latch end 74 is disposed in a notch 80 provided in the loop receiving recess 78, all for a purpose as will be hereinafter set forth. In addition, the latch member 68 is provided with a notch or shoulder 82 oppositely disposed with respect to the latch end 74 for receiving the end 66 of the bell crank 32 therein in one position of the latch 68, as particularly shown in FIG. 3.

It is particularly noted that the pivot pin 33 is disposed forwardly of the pivot pin 72, as viewed in FIGS. 2 and 3, considering that the trigger member 36 is disposed at the rear of the device 10, and the finger receiving bore 24 is at the front end thereof. This relationship between the two pivot pins appears to provide a more efficient result in the operation of the device 10 by permitting a quicker, more positive, more efficient action of the releasing of the latch member 68 as will be hereinafter set forth in detail.

A suitable flexible loop member 84, preferably constructed of a heavy string, or light rope material, but not limited thereto, has one end securely anchored to the half section 12 and the other end securely anchored to the half section 14 whereby the loop 84 extends loosely across the outer end of the secondary body member 20 in the proximity of the loop receiving recess 80. The loop member 84 may be wrapped about a bow string 86 of a bow (not shown) and placed in the loop receiving recess 80, as shown in my aforementioned co-pending application, for temporarily securing the bow string 86 to the device 10 in a manner and for a purpose as will be hereinafter set forth. Of course, the latch member 68 may be moved to the closed or latched position thereof as shown in FIG. 3 for retaining the loop 84 within the recess 80, as moved to the open or unlatched position thereof as shown in FIG. 2 for releasing the loop 86 from the recess 80.

In use, the device 10 may be comfortably held in the hand (not shown) of the archer as shown in my aforementioned co-pending application. The forefinger (not shown) may be inserted through the aperture 24, and the thumb (not shown) may be placed adjacent the outer edge of the device at the juncture between the body portions 18 and 20. The remaining fingers (not shown) may be positioned against the finger receiving contoured portion 22, thus comfortably supporting the device 10 in the hand (not shown). Prior to using the device 10, the trigger mechanism 36 is preferably preset by manually engaging the head 52 of the lever 46 and moving the lever inwardly against the force of the spring 54 until the bell crank 39 is in engagement with the shoulder 50 of the lever 46, as shown in FIG. 3.

During use of the device 10 for drawing or pulling the bow string 86 taut it is preferable that the device 10 be held in such a manner that the plane of the body portions 18 and 20 be substantially horizontally disposed, with the loop 84 being positioned in the proximity of the bow string 86. The loop 84 may then be manually wrapped around the string 86 one time and brought back into position within the loop receiving recess 80, as shown in FIGS. 1 and 3. The latch member 68 may then be manually pivoted about the pivot pin 72 to the closed position shown in FIGS. 1 and 3 for securely retaining the loop 84 in the recess 80. In this position of the latch 68, and with the lever 46 engaged by the bell crank 39, the end 66 of the bell crank 32 will automatically engage the shoulder 82 because of the force of the spring 60 acting on the bell crank 32. The bow (not shown) may be held in the usual position, and the bow string 86 may be drawn away from the bow by applying pressure against the device 10, in lieu of the conventional present-day method of pulling against the string with the fingers.

Of course, an arrow (not shown) may be positioned in connection with the bow and string 86 in the usual manner, with the string 86 being disposed in the notch of the arrow and the point end of the arrow being disposed at a resting position on the hand of the archer. When the string 86 has been properly drawn or pulled away from the bow and the arrow is to be released, the trigger head 40 may be engaged by the little finger of the hand, whereupon the bell crank member 39 will be rotated in a clockwise direction about the pivot pin 41 and against the force of the spring 64, as viewed in FIG. 2. This action releases the bell crank 39 from engagement with the shoulder 50 of the lever 46 whereupon the expansion of the spring 54 moves the lever 46 in an outward direction. The shoulder 48 is then brought into engagement with the end 58 of the bell crank 32, causing the bell crank 32 to rotate in a clockwise direction about the pivot pin 33, as viewed in FIG. 2, and against the force of the spring 60. This action pulls the end 66 of the bell crank 39 away from the shoulder 82 and releases the latch member 68, which is then free to pivot about the pin 72 in a clockwise direction as viewed in the drawings. The movement of the latch member 68 opens the loop recess 80 for releasing the loop 84 therefrom. Of course, the tension in the string 86 causes the string to immediately disengage from the loop 84 and propel the arrow (not shown) forwardly from the bow (not shown).

The amount of pressure required for activation of the trigger member 36 is extremely slight, and the action of the bell cranks 39 and 32 is very rapid and accurate, thus providing an efficient release of the string 86 for accuracy of the projection of the arrow. Of course, the pressure required for actuation of the trigger 36 may be controlled by the force of the springs 54,60 and 64, and these springs are preferably selected to provide the optimum or most desirable pressure response action for the trigger mechanism 36.

The force of the spring 60 against the end 58 of the bell crank or arm 32 is in a counterclockwise direction about the pivot 33, as viewed in FIG. 3, whereas the pressure of the bow string 86 on the rope 84 and in turn on the outer end 74 of the latch member 68 creates a pressure on the bell crank 32 in a clockwise direction about the pivot 33. Additional pressure in a clockwise direction is applied to the bell crank 32 by the shoulder 48 when the operator's finger is pressed against the head 40. When the combined pressures or forces of the trigger mechanism 36 and latch 68 overcomes the pressure or force of the spring 60, the bell crank 32 will instantly pivot in a clockwise direction about this pivot 33. Thus, the release of the bow string 86 is directly in relation to the pressure of the bow string applied to the outer end 74 of the latch 68 by the rope 86.

Subsequent to one arrow shooting operation, the procedure may be repeated by again wrapping the loop 84 around the string 86 and placing the loop in the recess 80, and again moving the latch member 68 to the locked or latch position thereof, and resetting the trigger mechanism 36 by depressing the lever 46 as hereinbefore set forth. When the arrow has been properly positioned in combination with the bow and string 86, and the string 86 has been pulled or drawn, the trigger member 36 may again be actuated for quickly and smoothly releasing the loop 84 from the recess 80, and thus releasing the string 86.

Figure 6:
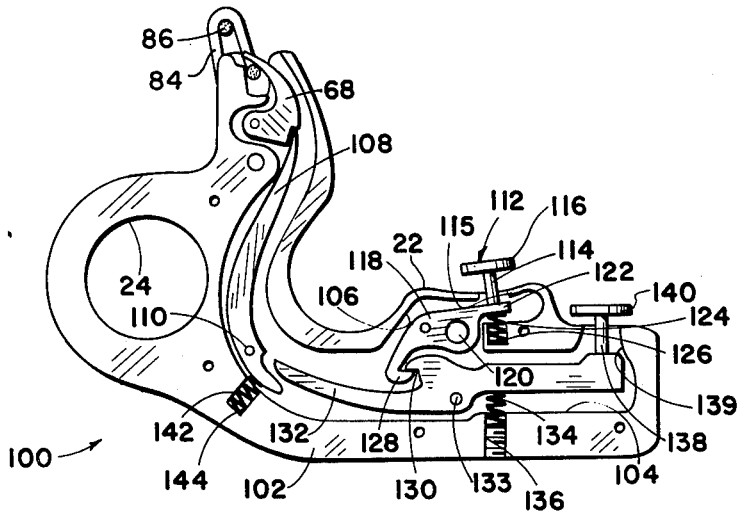
FIG. 6 is a view similar to FIG. 5 illustrating the latch member in a closed position.
Figure 5:
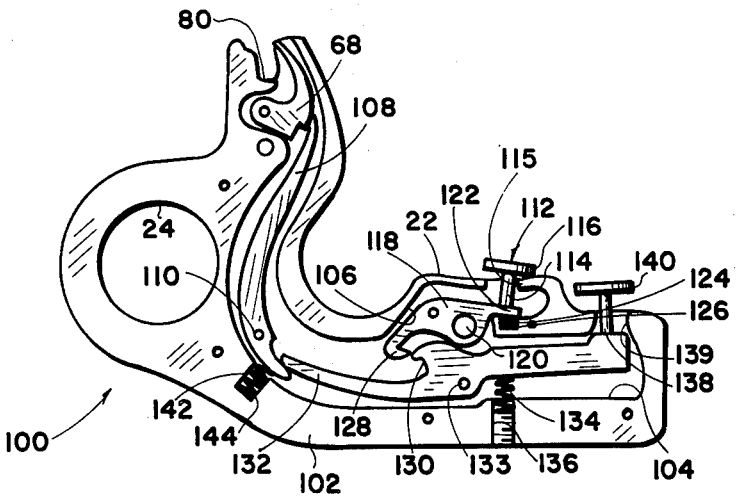
FIG. 5 is a side elevational view of one half section of the bow string draw and release device shown in FIG. 4 and illustrating the latch member in an open position.
Figure 4:
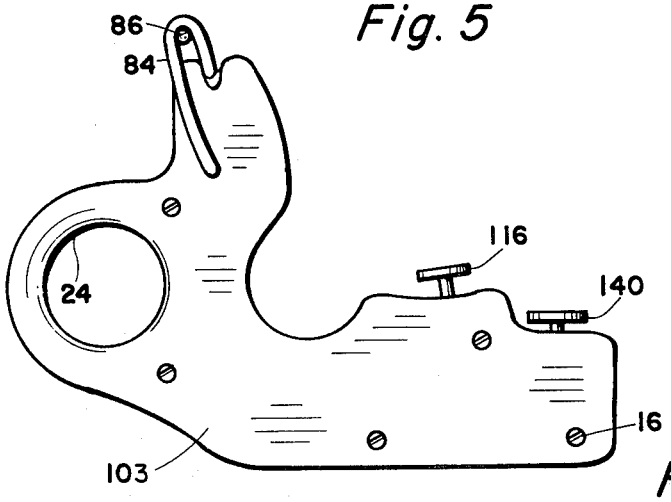
FIG. 4 is a side elevational view of a modified bow string draw and release device embodying the invention.

Referring now to FIGS. 4,5 and 6, a similar bow string draw and release device is generally indicated at 100 which comprises a pair of substantially identical but opposite half sections 102 and 103 and which are substantially identical to the half sections 12 and 13 hereinbefore set forth. Each half section 102 and 103 includes the finger receiving aperture 24 and is of an outer configuration including the finger receiving recesses 22 as hereinbefore set forth. In addition, a substantially L-shaped groove or recess 104 is provided on the inwardly directed face of each half section 102 and 103 for cooperating with the groove 104 of the other half section 102 to provide an internal passageway for the device 100. An off-set recess 106 is also provided on the inwardly directed face of each half section 102 in communication with the respective recess 104, as clearly shown in FIGS. 5 and 6.

The recess 104 is generally similar to the recess 28 and is provided with the pivotal latch member 68 at the open outer end thereof as hereinbefore set forth, as well as a loop receiving groove 80 for cooperating with the loop 84 carried by the half sections 102 as set forth in connection with the half sections 12. A bell crank 108 is pivotally secured within the recess 104 at 110 and functions in the same general manner as the bell crank 32 for cooperation with the latch member 68 during use of the device 100. A trigger mechanism generally indicated at 112 is mounted or installed in the recesses 104 and 106 for cooperating with the bell crank 108 for actuation thereof in the same general manner as the trigger mechanism 36 hereinbefore set forth.

The trigger mechanism 112 comprises a stem 114 extending through an aperture 115 and into the recess 106 and provided with a head member 116 thereon which is disposed exteriorly of the body 102. A second bell crank 118 is pivotally secured within the recess 106 at 120 and is provided with a finger element 122 at one end thereof for engagement by the stem 114. A suitable helical spring 124 is disposed in a recess 126 provided in the body 102 conterminous with the recess 106, and constantly bears against the finger element 122 oppositely urged in a counterclockwise direction about the pivot point 120, as viewed in FIGS. 5 and 6.

The opposite end of the bell crank 118 is provided with a hook member 128 which intermittently engages a complementary hook member 130 provided on a pivotal lever member 132, which is pivotally secured in the recess 104 at 133. The lever 132 is constantly urged in a counterclockwise direction about the pivot point 133 by a suitable helical spring 134 disposed in a bore 136 provided in the body 102 conterminous with or in communication with the recess 104. A suitable retainer screw 138 is threadedly secured in the bore 136 to provide for adjustment of the force of the spring 134 against the lever 132. A stem member 138 is suitably secured to one end of the lever 132 and extends outwardly through a suitable aperture 139 for supporting a head member 140 exteriorly of the body 102. The opposite end of the lever 132 intermittently engages the end of the bell crank 108 oppositely disposed from the latch member 68. A suitable helical spring 142 is disposed in a recess 144 provided in the body 102 whereby the lever member 108 is constantly urged in a clockwise direction about the pivot pin 110. The spring 142 retains the bell crank 108 in a normally engaged position with the latch member 68.

The use of the device 100 is substantially identical with the use of the device 10 as hereinbefore set forth. However, in order to set the trigger mechanism 112, the head 140 may be manually engaged for moving the lever 132 in a clockwise direction about the pivot 133 whereby the hook member 130 is brought into engagement with the hook member 128, and the lever 132 is moved away from engagement with the bell crank 108. The spring 142 will retain the bell crank 108 in engagement with the latch member 68 for retaining the latch in the closed position for holding the loop 84 and bow string 86 as hereinbefore set forth.

In order to release the bow string, the had member 116 may be manually engaged by a finger of the hand (not shown) of the operator whereby the bell crank 118 is pivoted in a clockwise direction about the pivot 120 and against the force of the spring 124. This releases the engagement of the hook member 128 with the hook member 130, and the spring 134 moves the lever 132 in a counterclockwise direction about the pivot 133. The lever 134 then engages the bell crank 108 in a clockwise direction against the force of the spring 142 for releasing the engagement of the bell crank 108 with the latch member 68. The loop 84 and bow string 86 are thus released in the manner as hereinbefore set forth for propelling the arrow in a forward direction.

Figure 9:
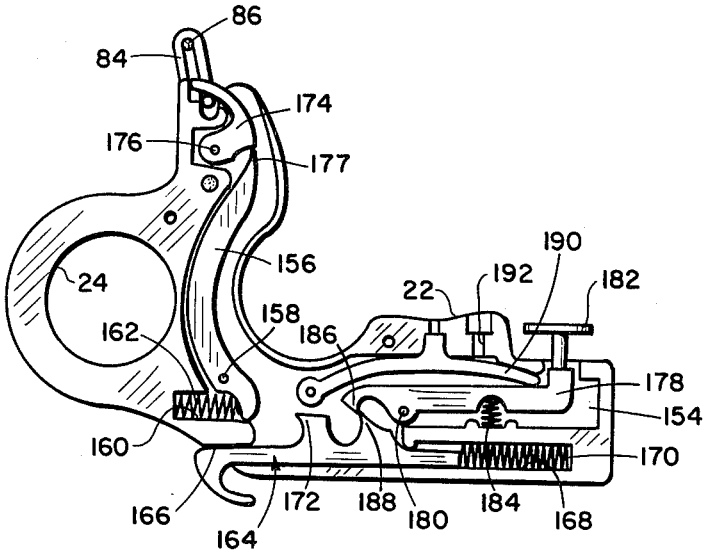
FIG. 9 is a view similar to FIG. 8 illustrating the latch member in a closed position.
Figure 8:
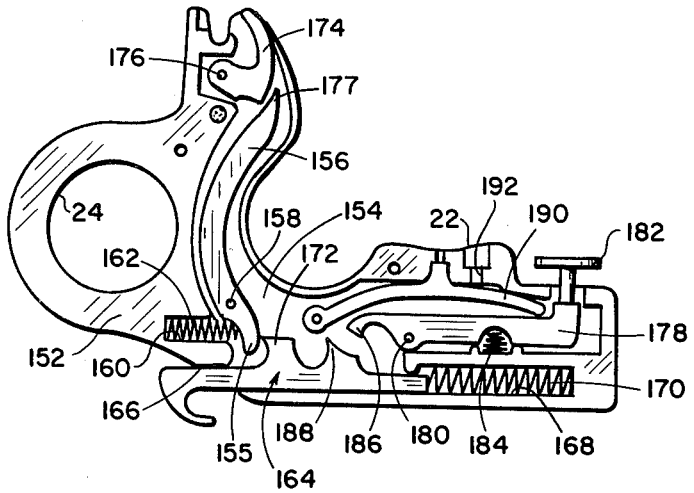
FIG. 8 is a side elevational view of one half section of the bow string draw and release device shown in FIG. 7 and illustrates the latch member in an open position.
Figure 7:
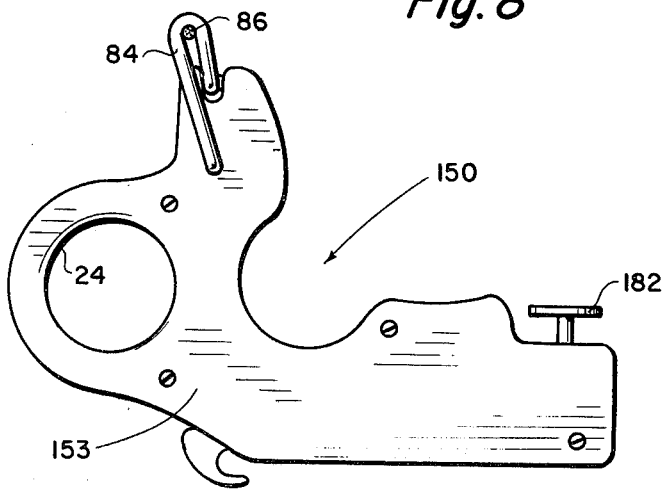
FIG. 7 is a side elevational view of another modified bow string draw and release device embodying the invention.

Referring now to FIGS. 7 through 9, reference character 150 generally indicates a modified bow string draw and release device similar to the device 10 and comprising a pair of substantially identical but opposite half sections 152 and 153 corresponding to the half sections 12 and 13. Each half section 152 and 153 is provided with a finger receiving aperture 24 and an outer configuration including the finger receiving recesses 22 as hereinbefore set forth. A substantially L-shaped groove 154 generally similar to the recess or groove 28 is provided on the inwardly directed face of each half section 152 and 153 to provide an internal passageway for receiving a first bell crank member 156 which is pivotally secured therein at 158. A recess 160 is provided in communication with the recess 154 in the proximity of the lowermost end 155 of the crank 156, as viewed in FIGS. 8 and 9, and a suitable helical spring 162 is disposed in the recess 160 and engages the end 155 of the crank 156 for constantly urging the crank 156 in a counterclockwise direction about the pivot 158.

A lever member 164 is slidably disposed within the recess 154 and in the proximity of the end 155 of the crank 156. The lever 164 extends outwardly through a recess 166 in the same general manner as the lever 46. The inner end of the lever 164 normally extends into an offset recess or passageway 168 which is in open communication with the recess 154, and a suitable helical spring 170 is disposed in the recess 168 for engagement with the inner end of the lever 164 for constantly urging the lever 164 in a left hand direction as viewed in the drawings. The lever 164 is provided witn an outwardly extending shoulder member 172 which normally maintained in engagement with the end 155 by the spring 170, as particularly shown in FIG. 8.

A latch member 174 substantially identical with the latch member 68 is pivotally secured at 176 in the proximity of the upper end 177 of the crank 156 and functions in the same manner and for the same purpose as the latch 68 for alternately retaining and releasing the bow string 86 from engagement with the loop 84 during the shooting or propelling of an arrow with the device 150. When the end 155 of the crank 156 is in the position shown in FIG. 8, the end 177 is released from engagement with the latch 174, and the latch 174 is in the open or released position therefor. When the lever 164 is removed from engagement with the end 155, as will be hereinafter set forth, the end 177 is in engagement with the latch 174 by the force of the spring 162, as shown in FIG. 9.

A second bell crank 178 is pivotally secured in the recess 154 as shown at 180, and may be selectively pivoted about the pivot 180 by a trigger member 182 which is substantially identical to the trigger member 36 and functions in substantially the same manner. A suitable helical spring 184 is interposed between the edge of the recess 154 and the crank 178 for constantly urging the bell crank 178 in a counterclockwise direction about the pivot 180. A hook-like element 186 is provided on the inner end of the crank 178 for selective engagement with a complementary shoulder 188 provided on the lever 164 in spaced relation with respect to the shoulder 172. When the lever 164 is manually pushed in a direction against the force of the spring 170, the hook 186 will engage the shoulder 188 since the crank 178 is urged in said counterclockwise direction about the pivot 180. Of course, the engagement between the hook 186 and shoulder 188 retains the lever 164 in a disengaged position with respect to the crank 156, as shown in FIG. 9.

A pivotal adjustment member 190 is suitably secured in the recess 154 in such a manner that the outer end thereof is in constant engagement with the bell crank 178, and acting on the crank 178 in a direction opposite from the force of the spring 184. A suitable set screw or the like (not shown) is preferably adjustably secured in a threaded aperture 192 for engagement with the adjustment member 190 in order that the force required for operation of the bell crank 178 may be selectively adjusted, thus providing an adjustment for the force required to operate the release device 150.

The operation of the apparatus 150 is substantially identical with the operation of the devices 10 and 100 as hereinbefore set forth.

From the foregoing it will be apparent that the present invention provides a novel bow string draw and release device having a main body portion designed for comfortably receiving the fingers of the hand therearound, and a secondary body portion carrying a quick-release latching mechanism for temporarily retaining a bow string holding loop member in order to facilitate drawing of the bow string and for quickly, smoothly, and efficiently releasing the loop member for release of the bow string to perform an arrow shooting operation with ease and accuracy. The novel device is simple and efficient in operation and economical and durable in construction.

Whereas the present invention has been described in particular relation to the drawings attached hereto, it should be understood that other and further modifications apart from those shown or suggested herein may be made within the spirit and scope of this invention.

What is claimed is:

1. A draw and release device for a bow string and comprising a generally L-shaped body means contoured for gripping by a hand and having a substantially co-extensive L-shaped internal passageway means with an open end for receiving a bow string, latch means alternately engageable and releasable with respect to a bow string, a first pivotal bell crank means disposed within said passageway means for movement between latch means engaging and releasing positions, independent trigger means carried by said body means and operably connected with said first bell crank means for selective pivoting of said first bell crank means to pivot said first bell crank means so as to release said latch means from a bow string engaging position, said latch means being pivotally secured within said body means and in communication with said passageway means for selective engagement by said first bell crank means, flexible loop means secured to said body means for selective engagement with a bow string, loop receiving recess means provided on the outer periphery of said body means for removably receiving said loop means therein, said latch means extending transversely across said loop receiving recess means and being selectively engageable therewith for alternate opening and closing thereof to alternately retain and release said loop means with respect to said loop receiving recess means, said trigger means comprising lever means movably secured in said passageway means selectively engageable with said first bell crank means for providing said release of the latch means, and second bell crank means pivotally secured in said passageway means for selective engagement with the movable lever means to control the engagement of the lever means with the said first bell crank means for providing said release of the latch means.

2. A draw and release device for a bow string as set forth in claim 1 wherein the lever means is reciprocally movable within said passageway for producing said selective engagement with the first bell crank means.

3. A draw and release device for a bow string as set forth in claim 1 wherein the lever means is pivotally secured within said passageway for producing said selective engagement with the first bell crank means.

* * * * *